US006181300B1

(12) United States Patent
Poon et al.

(10) Patent No.: US 6,181,300 B1
(45) Date of Patent: Jan. 30, 2001

(54) DISPLAY FORMAT CONVERSION CIRCUIT WITH RESYNCHRONIZATION OF MULTIPLE DISPLAY SCREENS

(75) Inventors: Wai-Leong Poon, Richmond Hill; David Chih, Scarborough, both of (CA)

(73) Assignee: ATI Technologies, Thornhill (CA)

( * ) Notice: Under 35 U.S.C. 154(b), the term of this patent shall be extended for 0 days.

(21) Appl. No.: 09/150,439

(22) Filed: Sep. 9, 1998

(51) Int. Cl.[7] ..... G09G 1/00

(52) U.S. Cl. ..... 345/1; 345/3; 345/132; 345/213

(58) Field of Search ..... 345/1, 3, 132, 345/213

(56) References Cited

U.S. PATENT DOCUMENTS 5,111,190 * 5/1992 Zenda ..... 345/3
5,309,168 * 5/1994 Itoh et al. ..... 345/3
5,396,258 * 3/1995 Zenda ..... 345/3
5,579,025 * 11/1996 Itoh ..... 345/3
5,592,187 * 1/1997 Zenda ..... 345/3
5,963,200 * 10/1999 Deering et al. ..... 345/213
6,037,925 * 3/2000 Kim ..... 345/99

* cited by examiner

*Primary Examiner*—Bipin Shalwala
*Assistant Examiner*—Vincent E. Kovalick
(74) *Attorney, Agent, or Firm*—Markison & Reckamp, P.C.

(57) ABSTRACT

A display data format conversion circuit and method facilitates display of data on a plurality of display devices based on display data of a source display device. The system incorporates a resynchronization circuit that dynamically varies a frame rate of one display device based on the instantaneous frame rate of the source device to maintain synchronization of the displays. A display timing generator circuit for a first display, such as an LCD display, produces a first display timing signal. The resynchronization circuit is operatively responsive to the first display timing signal and a second display timing signal wherein the second display timing signal is associated with a second display device, such as a source display device. In one embodiment, the resynchronization circuit includes a vertical blanking time variation circuit that adaptively and continuously varies the frame rate of the first display device by varying a vertical blanking time of the first display device.

28 Claims, 6 Drawing Sheets

DISPLAY FORMAT CONVERSION CIRCUIT WITH RESYNCHRONIZATION OF MULTIPLE DISPLAY SCREENS

FIELD OF THE INVENTION

The invention relates generally to resynchronization circuits for image display systems and more particularly to display data format conversion circuits and methods that facilitate display on a plurality of display devices.

BACKGROUND OF THE INVENTION

Today's computer systems incorporate an increasing amount of video and graphic display features to allow laptop computers and other computers to display video images such as movies, television images and graphic images on multiple displays. For example many computers such as a laptop computer may provide an additional display drive port to allow dual display on an LCD display for the laptop as well as a cathode ray tube (CRT) monitor to allow dual display of information, coming from the laptop computer. A problem arises in trying to dynamically synchronize display data for dual display so that the frame rate on both display devices is the same. The problem becomes compounded by the fact that different display devices can have varying refresh rates and display resolutions from frame to frame. For example, an LCD display may have a different resolution from the CRT resolution so that ratiometric expansion is necessary. This may occur for example where the CRT has a screen size of 600×800 pixels whereas the LCD display has a display of 768×1024 pixels.

Where display drive chips, such as computer graphic chips, have an internal clock used for display timing control for one display device, another display control chip may be used having a different internal clock used for display timing for another display device. Typically, these clock frequencies are out of synchronization so the display on each of these screens may be different over time. The synchronization is even more difficult when one of the display devices frame rate's is unstable from time to time, for example, due to signals generated by genlocking. As known in the art, genlocking is used during the reconstruction of an encoded video signal in a video decoder. A video decoder needs to generate a pixel clock that is used in clocking the pixel data into the other processing circuitry or memory. The generation of this pixel clock can be difficult especially when the video source frame rate stability is poor such as with a VCR, One method of overcoming this problem is to store an entire frame in a buffer so that no resynchronization needs to occur. However such a design can require large amounts of expensive memory to accommodate video display for large screens on display devices.

Systems are known that attempt to synchronize displays by allowing a user to preselect a static synchronization offset that is applied irrespective of actual synchronization error. Such systems may use a change in vertical blanking period as a method for facilitating the static resynchronization. However, display systems may have unstable source clocks that vary over time or may otherwise display images at differing display rates from one frame to another due to circuit temperature variations or other variations. Static synchronization systems cannot typically compensate for such deviation thereby resulting in asynchronized multiple displays.

Consequently, there exists a need for a display data format conversion circuit and method that facilitates display on a plurality of display devices when the display devices have different resolutions or when the frame rate of the source is unstable. It would be desirable if such a system minimized the amount of data needed to be stored to decrease the cost of the synchronization system.

DETAILED DESCRIPTION OF A PREFERRED EMBODIMENT OF THE INVENTION

Figure 1:
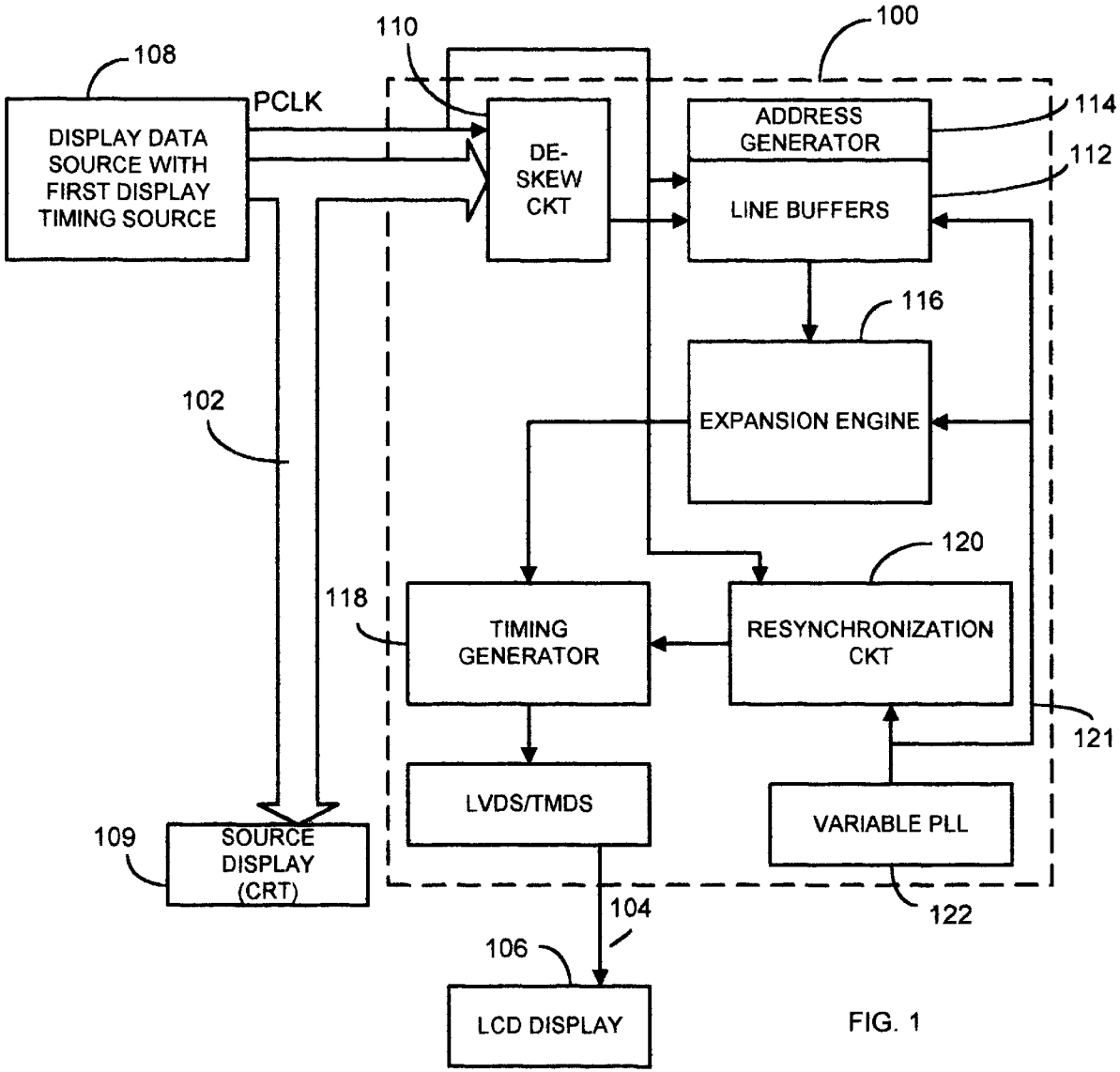
FIG. 1 is a block diagram illustrating a display interface system to allow the video or graphics controller to display information on a plurality of display devices.

An adaptive display data format conversion circuit and method facilitates display of data on a plurality of display devices based on display data of a source display device. The system incorporates a resynchronization circuit that dynamically evaluates frame synchronization to, if necessary, continuously vary a frame rate of one display device based on an instantaneous frame rate of the source device to maintain synchronization of the displays. A display timing generator circuit for a first display, such as an LCD display, produces a first display timing signal. The resynchronization circuit is operatively responsive to the first display timing signal and a second display timing signal wherein the second display timing signal is associated with a second display device, such as a source display device. The resynchronization circuit continuously varies a frame rate of the first display device to be consistent with the frame rate of the second display device based on the first display timing signal and the second display timing signal.

In one embodiment, the resynchronization circuit includes a dynamic vertical blanking time variation circuit that dynamically varies the frame rate of the first display device by varying a vertical blanking time of the first display device on a frame by frame basis, if necessary. The resynchronization circuit synchronizes the frame rate on both display devices to facilitate synchronized dual display of common display data. The system may also vary a horizontal blanking interval in addition to or instead of the vertical blanking time.

In one embodiment, the resynchronization circuit includes a frame error determinator that uses display resolution data of the two display devices and the display timing signal of the two devices to generate frame timing correction data for each frame based on expected end of frame data and actual end of frame data. If desired, the circuit may also include a display line buffer that stores received display data representing plurality of display lines. An upscaling circuit is coupled to the display line storage device to facilitate conversion of the display data for the second display device for display on the first display device when the first display device has a higher resolution than the second device. In this way the entire frame need not be stored.

As such, the disclosed system and method varies the frame rate of one display device to correspond to the frame rate of the other display device by continuously evaluating each fame and, if necessary, dynamically varying the vertical blanking time of one of the display devices every frame. Depending on the frame error of each frame, the amount of the blanking time that needs to be varied can be different from time to time. The frame rate of one display device is used as the mechanism by which the frame rate of the second device is controlled. In addition, any delay that is necessary to facilitate simultaneous display over display devices having different resolutions, is distributed among multiple display lines in the non-active display region of the screen, or vertical blanking period, when the delay is greater than the standard line length.

FIG. 1 shows by way of example, a display data format conversion circuit 100 that converts display data 102, such as 24-bit RGB data for a source display 103, such as a CRT display, to display data 104 for display on a display device 106, such as a thin film transistor (TFT) LCD display. A display data source 108, such as a video graphics chip or other source, provides the display data 102 and may also provide the display data 102. Preferably, although not required, the display data format conversion circuit 100 may be a separate integrated circuit having its own controllable and clock source 122 and the data display source 108 may be a separate chip having its own clock source. However, the display data format conversion circuit 100 may be incorporated as part of the display data source 108, or other system if desired.

The display data format conversion circuit 100 includes de-skew circuitry 110, a line buffer 112 with an associated address generator 114, a ratiometric expansion engine 116, a timing generator circuit 118, a resynchronization circuit 120 and the clock source 122, such as a programmable phase lock loop (PLL) circuit. The de-skew circuitry 110 compensates for delay in transmission of the display data 102 from the display source 108 to be displayed at a format conversion circuit 100 to align the bits. The line buffer 112 and associated address generator 114 stores enough data for the expansion engine 116 to provide upscaling when the LCD display has a higher resolution than the CRT display 109, as known in the art. As known, the line buffer provides enough delay so that the expansion engine may determine and generate the additional upscaled data for display on the LCD display 106.

The timing generator 118 and resynchronization circuit 120 serve to generate a variable display timing signal 121 on a frame by frame basis, if necessary, to continuously vary the frame rate of the LCD display device based on a current state of the display of CRT 109. The resynchronization circuit 120 dynamically varies the frame rate of the LCD device to be consistent with the frame rate of the CRT device to facilitate synchronized dual display of common display data 102 on the multiple display devices by evaluating frame error every frame and correcting for dynamically detected frame error, if any, before the next frame begins. The correction is done down to the last pixel.

Figure 2:
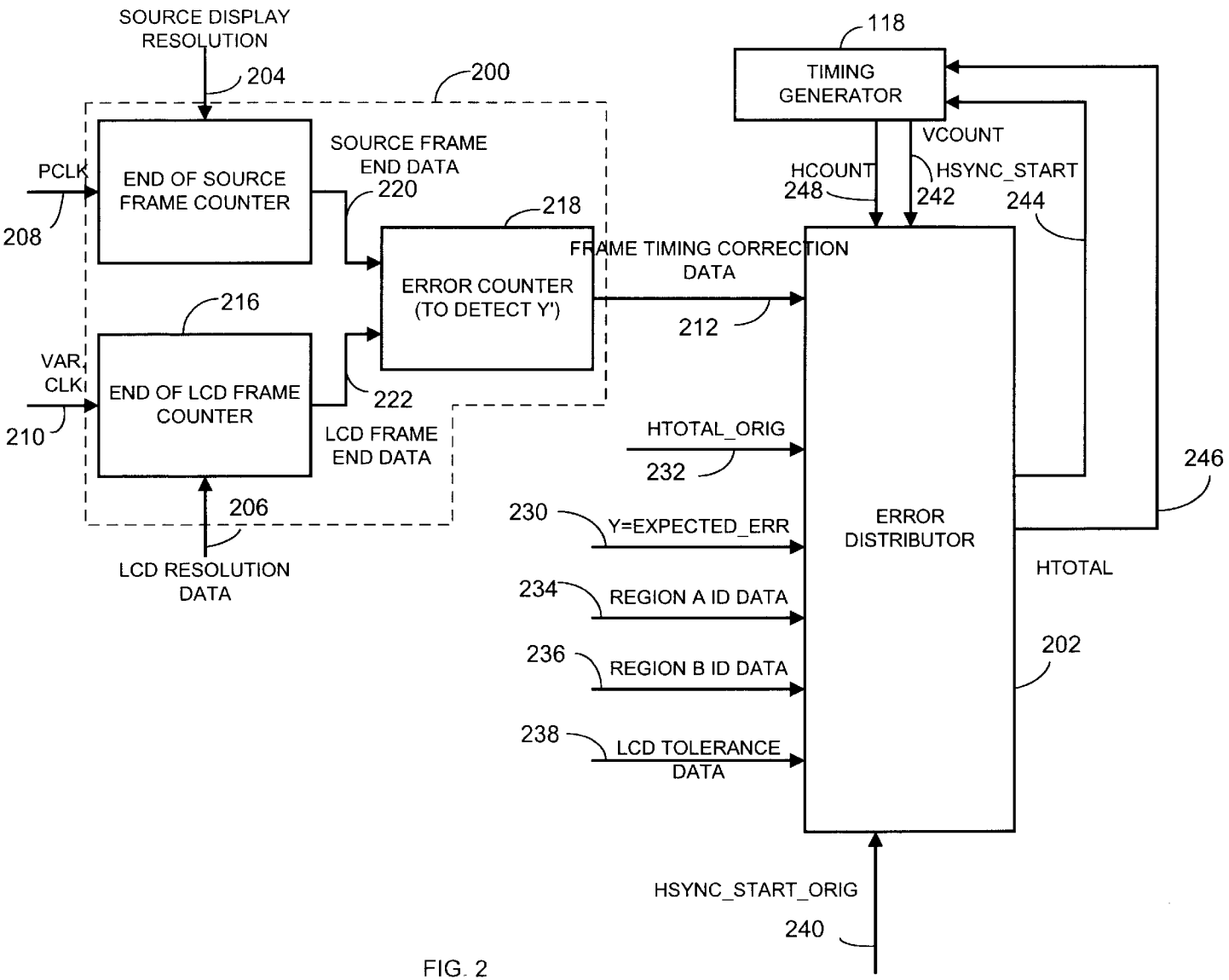
FIG. 2 is a block diagram illustrating an example of one embodiment of a display data format conversion circuit in accordance with the invention.

FIG. 2 shows the timing generator 118 and resynchronization circuitry 120 in more detail. The resynchronization circuit 120 includes a frame error determinator 200 and an error distribution generator 202. The frame error determinator 200 receives display resolution data 204 and 206 which represents the resolution of each of the displays. The horizontal display resolution is determined by calculating the number of clock cycles between each display enable pulse from the source data 108. The vertical resolution is obtained from the cathode ray tube controller (CRTC) registers of the source display. Display resolution data 206 for the LCD panel 106 are obtained from the LCD CRTC register.

The frame error determinator 200 dynamically evaluates the frame error of each frame to calculate the frame error of each frame on a continuous basis. It receives, on a frame by frame basis, the display timing signal 208 (PCLK) corresponding to the display clock for the CRT 109, and receives an additional display timing signal 210 from clock source 122 representing the separate display timing clock for the display data format conversion circuit 100. The frame error determinator 200 generates frame timing correction data 212 based on expected end of frame data and actual end of frame data as determined based on the panel resolution information and the separate display timing signals 208 and 210.

The frame error determinator 200 includes an end of source frame counter 214, an end of LCD frame counter 216 and an error counter 218. As shown, the end of source frame counter 214 receives the display resolution data 204 corresponding to the CRT device and the timing signal 208 associated with the CRT device. The frame counter 214 generates CRT display source frame end data 220 which represents the end of the frame of the CRT display device. The end of LCD frame counter 216 receives the display resolution data 206 corresponding to the LCD display device and also receives the display timing signal 210 corresponding to the LCD display device. The end of LCD frame counter 216, generates LCD display end of frame data 222. The error counter 218 generates the frame timing correction data 212 based on the end of frame data 220 and 222 from the source display and the LCD display.

The error distribution generator 202 allocates detected frame delay error among a number of regions of a display frame on the LCD display device. For example, if the vertical blanking time of the LCD display device is varied to synchronize with the display of the CRT device, the error distribution generator 202 distributes the error among multiple vertical blanking lines to ensure that the suitable amount of advance or retardation of pixel data is accommodated to suitably synchronize the LCD display with the CRT device.

As shown, the error distribution generator 202 receives expected error data 230 (Y), horizontal total (HTOTAL) origin data 232, which is used by the timing generator on lines where no correction is made, first region identification data 234 and second region identification data 236. The expected error data 230 represents an expected amount of frame delay due to buffering and ratiometric expanding. The region identification data 234 and 236 is data representing regions, such as groups of lines, that will be used to accommodate for any detected error. The error distribution generator 202 also receives panel tolerance data 238 indicating the amount of tolerance that the LCD display may accommodate before the LCD panel creates distortion on the display. This may be set by the manufacturer for example and may be stored in a suitable register. In addition, the error distribution generator 202 receives synchronization start origin data 240.

The error distribution generator 202 outputs horizontal synchronization start data 244 to timing generator 118. This data is varied based on the amount horizontal total data 246 is changed to ensure that a horizontal synchronization signal is generated. The timing generator 118 generates a timing control signal 248 to the error distribution generator to make sure that the HTOTAL value is changed on a new line and not a current line.

Figure 3A:
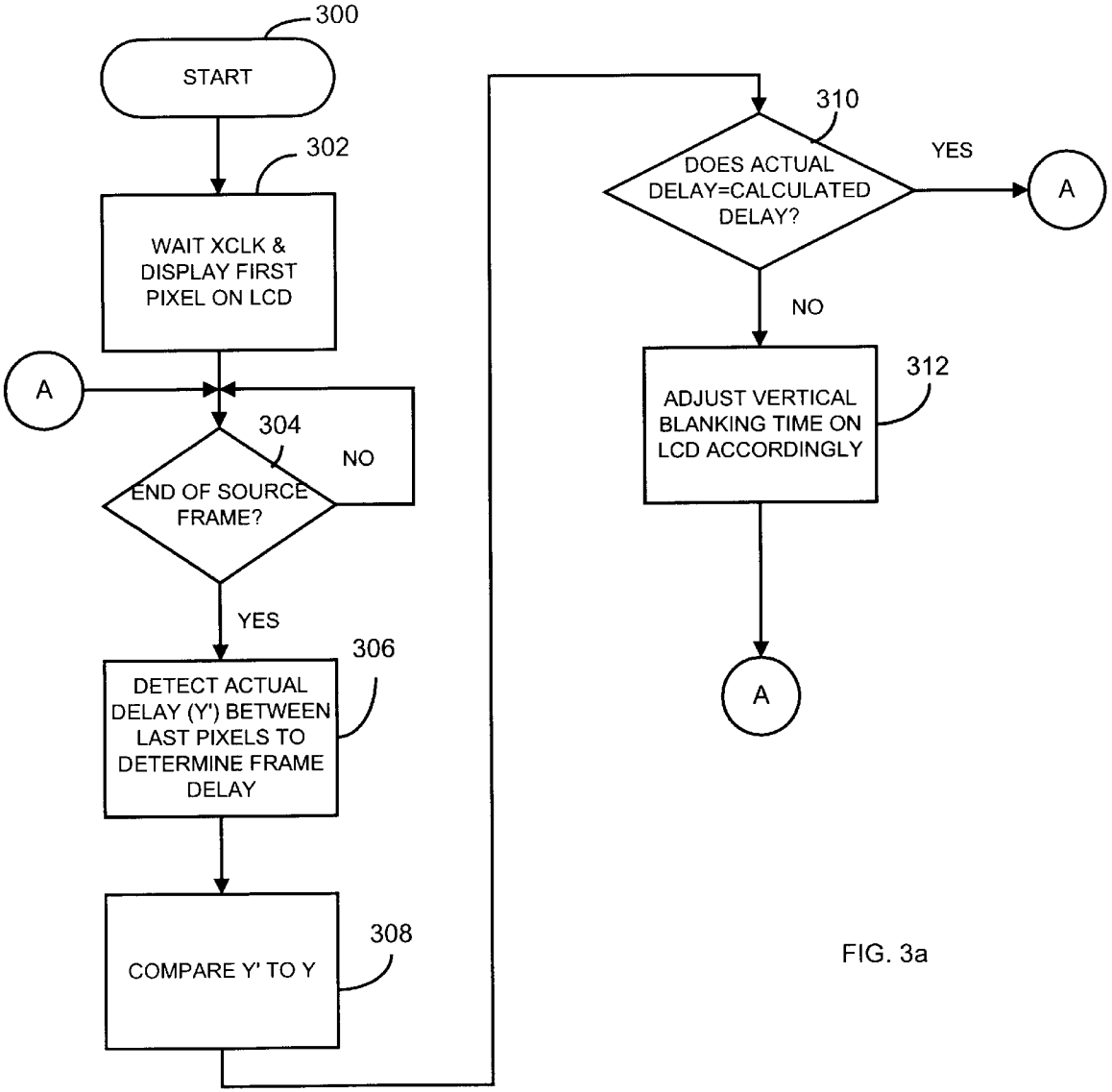
FIG. 3*a* is a flowchart generally depicting the operation of the display data format conversion system shown in FIG. 2.

FIG. 3*a* is a flow diagram generally indicating the overall operation of the system shown in FIG. 2. The registers are reset on power-up as shown in block 300. The YCLK represents the calculated delay associated with the last pixel of a frame between the source display (CRT) and relying display (LCD). As shown in block 302, the system waits for XCLK cycles and displays the first pixel. The XCLK data represents the best starting latency period as determined by simulating the line buffer data flow using any suitable simulation technique. For example, the input data goes into the buffer in one rate while leaving the line buffer at a different rate. If the XCLK latency does not exist, the incoming data would either be too fast or too slow for the buffer output. Using trial and error techniques, the latency may be found when there is no loss of data when data is read from the buffer. As shown in block 304, the system determines whether or not the end of the frame has occurred by monitoring end of frame signal data. The end of frame signal data may be obtained from the end of source frame counter 214 (FIG. 2) which keeps counting until the end of active display. It generates signal 220 to indicate the end of the frame. If the end of frame has not occurred, the system continues to display pixel data. If the end of a frame has occurred, the system determines the actual delay (Y') between the last pixel that was displayed to determine the frame delay Y'. This is shown in block 306. As shown in block 308, the system compares the actual delay Y' to the expected delay Y (or error calculated error). If the actual delay, Y', equals the calculated delay, the system continues to wait for an end of frame as shown This is shown in block 310. As shown in block 312, if the actual delay data Y' does not equal the calculated delay data Y, the system adjusts the vertical blanking time on the LCD display accordingly. For example, if the actual delay exceeds the calculated delay, indicating that the data being displayed on the LCD is occurring slower than the expected delay, the system will advance the display rate for the screen by adjusting the vertical blanking period to a shorter period. Conversely, if the actual delay is less than the calculated delay the vertical blanking period is modified so that the LCD display data is displayed slower. As such, the vertical blanking period would be increased to delay the display of information.

Figure 3B:
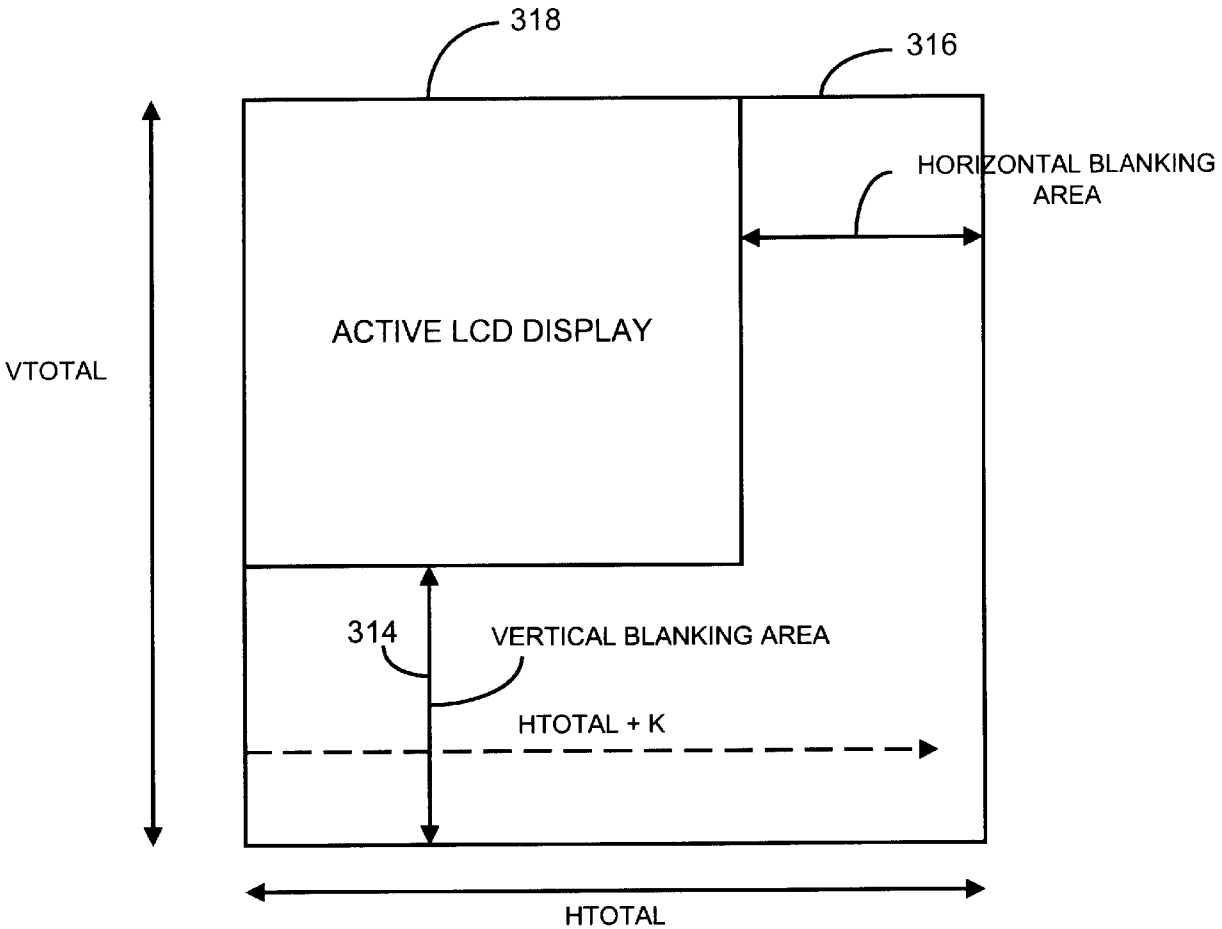
FIG. 3*b* is a graphic illustration showing the active display area and non-active display area of a screen and controlled vertical blanking variation to facilitate synchronization of frames in accordance with one embodiment of the invention.

FIG. 3*b* diagrammatically represents the vertical blanking area 314 and horizontal blanking area 316 on a screen having an active display region 318. If the expected error is greater than the actual error the system determines that the LCD display is displaying at a frame rate that is too fast and hence increases the vertical blanking period to increase the overall display period per frame. Similarly if the expected error is less than the actual delay, the LCD frame is determined to be too slow and the vertical blanking period would be decreased. This is accomplished by increasing the horizontal total line length by a factor K where K=Y−Y', K is less than the tolerance value 238.

Figure 4A:
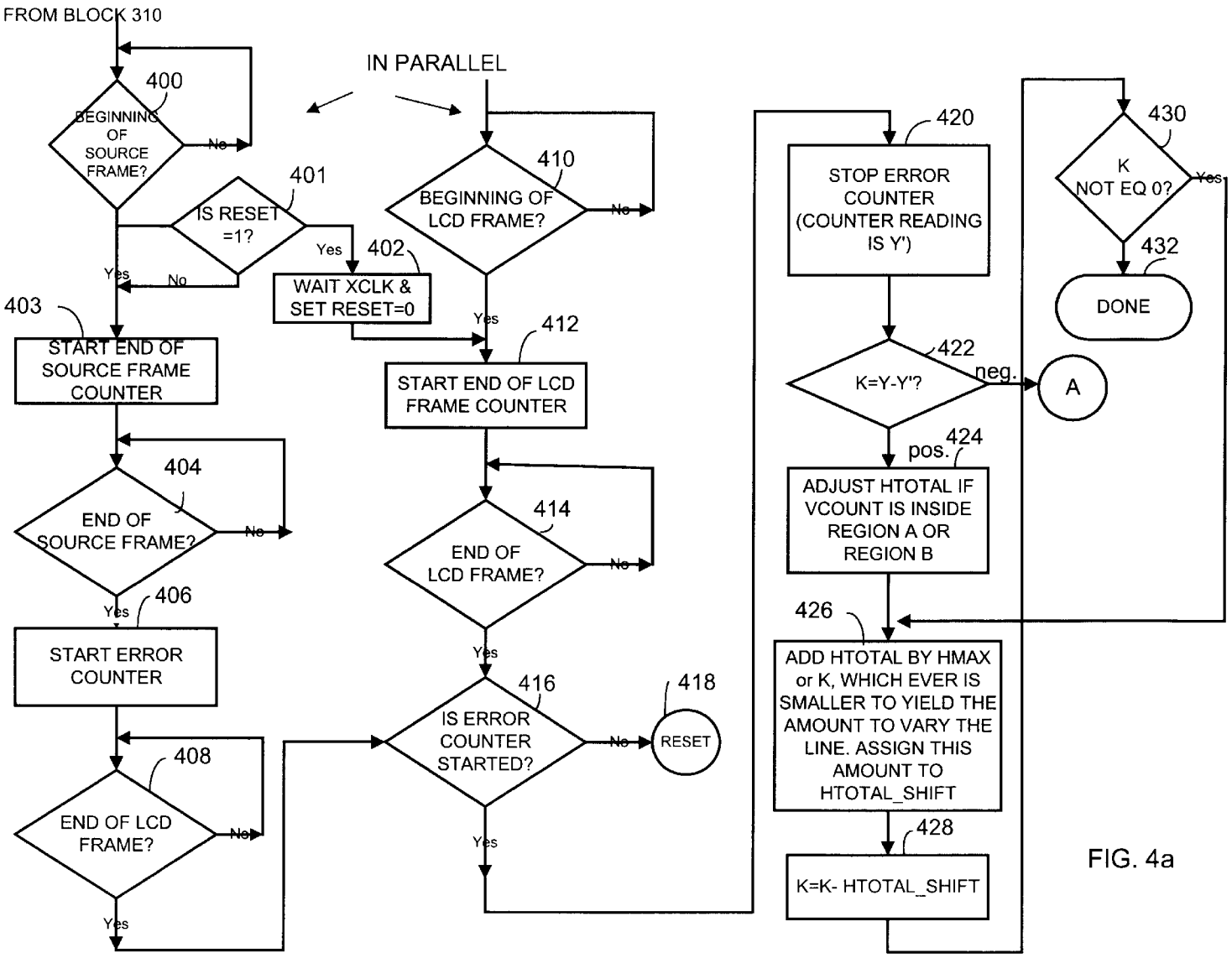
FIGS. 4*a*–4*b* is a flow diagram illustrating the operation of adjusting the vertical blanking time for a display device in accordance with one embodiment of the invention
Figure 4B:
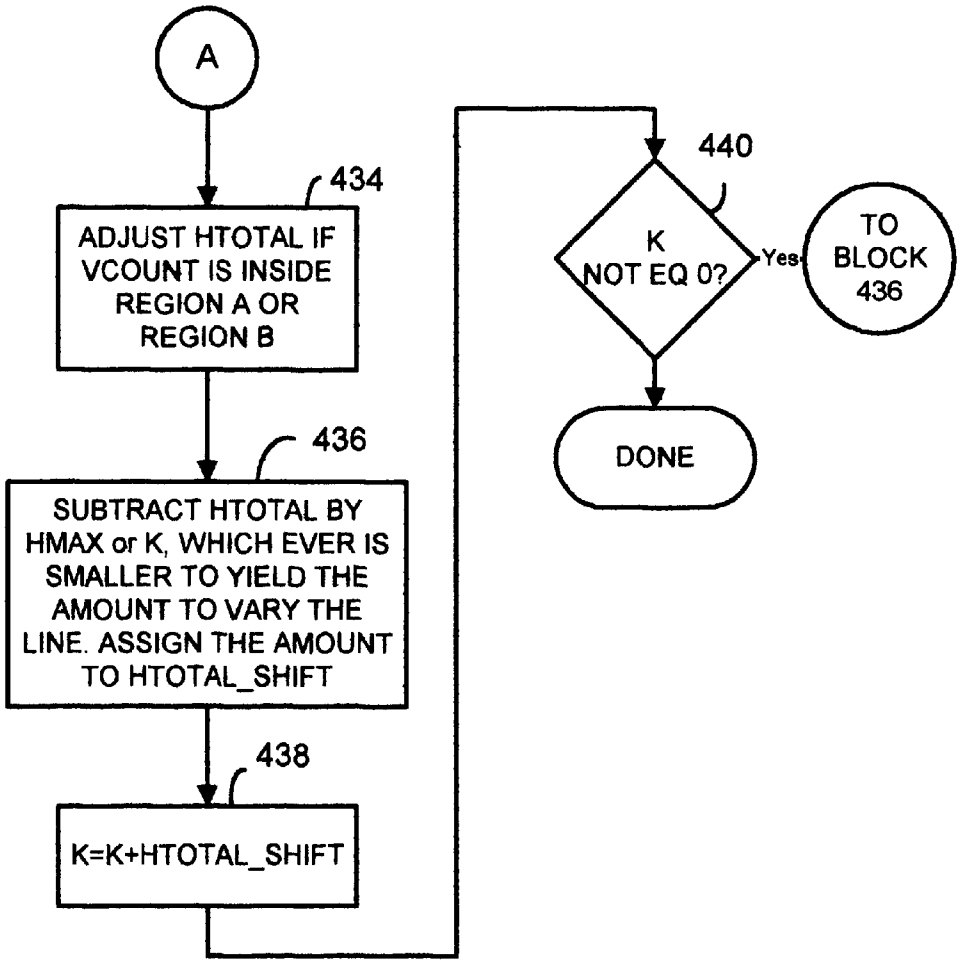

By way of further illustration, FIGS. 4*a*–4*b* show the process carried out by the system of FIG. 2 that adjusts the vertical blanking time as shown in block 312 of FIG. 3*a*. The process starts by determining whether the display data is the beginning of a source frame as shown in block 400. As shown in block 401, a reset bit is checked to see if the system has been reset. If not, the system operates normally. If a reset has been detected, the system resets and waits XCLK cycles to start the end of LCD frame counter and sets the reset value to zero. This is shown in block 402. Referring back to block 400, if it is not the beginning of source frame, such as the beginning of a frame of the source CRT, the system waits until the beginning of a source frame occurs. This is determined based on the source frame end data 220. The system starts the end of the source frame counter 214 if the beginning of the source frame was detected, as shown in block 403. As shown in block 404, the system determines whether an end of a source frame has occurred. This is determined by the source frame end data 220. If the end of frame has occurred, the error count counter 218 is initialized and continues to count until the end of an LCD frame occurs as shown in block 408. The end is determined by the LCD frame end data 222.

As shown in block 410, the system determines whether the LCD frame start has commenced, and if so, the end of LCD frame counter 216 is started as shown in block 412. As indicated in block 414, the system determines whether an end of an LCD frame has occurred based on the frame end data 222. If an end of LCD frame has occurred, the system determines whether the error counter 218 has been started, as shown in block 416. If the counter 218 has not been started to count, the error counter 218 is reset as shown by block 418. If the counter 218 has already started, the system stops the counter as shown in block 420. The counter value at this point will equal the actual delay Y'. This data Y' is used to determined the frame timing correction data, Y−Y'. This determination is shown in block 422. If a positive adjustment is indicated, the error distribution generator increases the HTOTAL value 346. The vertical count VCOUNT represents a line that is inside a region, such as region A or region B. Region A and region B represent two sets of line numbers for which HTOTAL can be varied. This is shown in block 424. Whether the HTOTAL can be modified depends upon in part the amount of tolerance indicated by tolerance data 238. As shown in block 426 the system will add the HTOTAL by the maximum amount allowable or by the factor K whichever is smaller. HTOTAL represents the normal number of clock cycles in one horizontal line before correction is indicated in FIG. 3*b*. The value of K represents the total error or variation needed over all of the lines in the regions to effect synchronization, (the total vertical lines). The variable HTOTAL_SHIFT is a temporary value representing the amount of variation that a given line needs to be varied. The sum of HTOTAL_SHIFT for all lines equals K. As shown in block 428, the magnitude of the factor K is reduced by the value HTOTAL_SHIFT after every correction in every line is made. As shown in block 430, the error distribution generator determines whether any error exists and if so will adjust the vertical blanking period by modifying HTOTAL. If no error exists, the system then waits for the next frame. This is shown in block 432.

If the error value (K) indicates that a retardation has to occur (the error value is a negative value), the system adjusts HTOTAL if VCOUNT is inside region A or Region B, as shown in block 434. As such, only lines in designated regions are adjusted to effect frame rate variation. The system subtracts HTOTAL by Hmax or K whichever is smaller as indicated in block 436. Hmax is the maximum amount allowable for HTOTAL to be adjusted without causing distortion on the LCD display. As shown in blocks 438–440, the system then determines whether K represents a positive shift or negative shift in the frame rate. The system then continues as previously indicated.

As shown, the system through the error distribution generator, distributes the error among the selected regions of vertical blanking lines and ensures that the total vertical blanking period does not exceed the total vertical number of lines. The distribution generator may be any suitable logic or programmed processing unit. The distribution error generator distributes error within the regions by determining whether a given line length can be varied.

Based on the above discussion, the disclosed system includes a resynchronization circuit for an image display system that varies the frame rate of a first display device to be consistent with the frame rate of a source display device. It will be apparent that more than two display devices can be synchronized using the disclosed system. An error or vertical blanking variation is distributed among selected regions within a non-active display area. The regions may be selected for example so that they do not exceed the total vertical display area of the LCD display.

It should be understood that the implementation of other variations and modifications of the invention in its various aspects will be apparent to those of ordinary skill in the art, and that the invention is not limited by the specific embodiments described. It is therefore contemplated to cover by the present invention, any and all modifications, variations, or equivalents that fall within the spirit and scope of the basic underlying principles disclosed and claimed herein.

What is claimed is:

1. A display data format conversion circuit to facilitate display on at least a first display device based on display data for a second display device comprising:

a first display timing generator circuit associated with the first display device that produces a first display timing signal wherein the first display timing generator includes a variable timing generator; and a resynchronization circuit, responsive to both the first display timing signal and a second display timing signal associated with the second display device, that dynamically evaluates frame synchronization to, if necessary, continuously vary a frame rate of the first display device to be consistent with a frame rate of the second display device by varying a blanking interval and includes a variable timing control signal generator circuit that generates a variable first display timing signal to vary the frame rate of the first display device.

2. The circuit of claim 1 wherein the resynchronization circuit includes a vertical blanking time variation circuit adapted to dynamically evaluate each frame and adaptively vary the frame rate of the first display device by continuously varying a vertical blanking time of the first display device3. The circuit of claim 1 wherein the first display timing generator is a variable timing generator and the resynchronization circuit includes a variable timing control signal generator circuit that generates a variable first display timing signal to vary the frame rate of the first display device.

3. The circuit of claim 1 wherein the resynchronization circuit continuously and adaptively varies a horizontal blanking interval to vary the frame rate of the first display device to be consistent with a frame rate of the second display device, to facilitate synchronized dual display of common display data on at least the first and second display devices.

4. The circuit of claim 1 wherein the resynchronization circuit includes a frame error determinator, responsive to display resolution data corresponding to at least each of the first and second display devices, the first display timing signal and the second display timing signal, that generates frame timing correction data at the end of a frame based on expected end of frame data and actual end of frame data.

5. The circuit of claim 4 wherein the frame error determinator includes:

a first counter operatively responsive to the display resolution data corresponding to at least the second display device and to the second display timing signal, that generates second display source frame end data;

a second counter, operatively responsive to the display resolution data corresponding to at least the first display device and to the first display timing signal, that generates first display end frame data;

a third counter, responsive to the second display source frame end data and to the first display end frame data, that generates the frame timing correction data for every frame.

6. The circuit of claim 1 wherein the resynchronization circuit includes a frame error distribution circuit that allocates detected frame delay error from each frame among a plurality of regions of a display frame on the first display device.

7. The circuit of claim 1 further including a display line buffer that stores received display data representing multiple display lines and an upscaling circuit in operative communication with the display line buffer to facilitate conversion of display data for the second display device for display on the first display device having a higher resolution than the second display device.

8. The circuit of claim 7 wherein the first display device is a liquid crystal display (LCD) device and wherein the second device is a cathode ray tube (CRT) display device.

9. A display data format conversion circuit to facilitate display on at least a first display device based on display data for a second display device comprising:

a first display timing generator circuit associated with the first display device that produces a first display timing signal; and a resynchronization circuit, responsive to both the first display timing signal and a second display timing signal associated with the second display device, that dynamically evaluates frame synchronization to, if necessary, continuously vary a frame rate of the first display device to be consistent with a frame rate of the second display device, having a vertical blanking time variation circuit that varies the frame rate of the first display device by dynamically varying a vertical blanking time of the first display device and wherein the resynchronization circuit includes a frame error determinator, responsive to display resolution data corresponding to at least each of the first and second display devices, the first display timing signal and the second display timing signal, that generates frame timing correction data based on expected end of frame data and actual end of frame data.

10. The circuit of claim 9 wherein the resynchronization circuit includes a frame error distribution circuit that allocates detected frame delay error among a plurality of regions of a display frame on the first display device.

11. The circuit of claim 9 further including a display line buffer that stores received display data representing multiple display lines and an upscaling circuit in operative communication with the display line buffer to facilitate conversion of display data for the second display device for display on the first display device having a higher resolution than the second display device.

12. The circuit of claim 11 wherein the first display device is a liquid crystal display (LCD) device and wherein the second device is a cathode ray tube (CRT) display device.

13. The circuit of claim 9 wherein the frame error determinator includes:

a first counter operatively responsive to the display resolution data corresponding to at least the second display device and to the second display timing signal, that generates second display source frame end data;

a second counter, operatively responsive to the display resolution data corresponding to at least the first display device and to the first display timing signal, that generates first display end frame data;

a third counter, responsive to the second display source frame end data and to the first display end frame data, that generates the frame timing correction data.

14. A display data format conversion method to facilitate display on at least a first display device based on display data for a second display device comprising:

producing a first display timing signal associated with the first display device; and resynchronizing display frames for the at least first and second display devices based on both the first display timing signal and a second display timing signal associated with the second display device, by dynamically evaluating frame synchronization to, if necessary, continuously vary a frame rate of the first display device to be consistent with a frame rate of the second display device by varying a blanking interval and generating frame timing correction data based on expected end of frame data and actual end of frame data.

15. The method of claim 14 wherein resynchronizing display frames includes dynamically varying the frame rate of the first display device by varying a vertical blanking time of the first display device.

16. The method of claim 14 including varying the frame rate of the first display device to be consistent with a frame rate of the second display device, to facilitate synchronized dual display of common display data on at least the first and second display devices.

17. The method of claim 14 including allocating detected frame delay error among a plurality of regions of a display frame on the first display device.

18. The method of claim 17 including:

generating second display source frame end data based on the display resolution data corresponding to at least the second display device and the second display timing signal;

generating first display end frame data based on the display resolution data corresponding to at least the first display device and the first display timing signal; and generating the frame timing correction data based on the second display source frame end data and the first display end frame data.

19. The method of claim 14 further including the step of storing received display data representing multiple display lines and upscaling display to facilitate conversion of display data for the second display device for display on the first display device having a higher resolution than the second display device.

20. The method of claim 19 wherein the first display device is a liquid crystal display (LCD) device and wherein the second device is a cathode ray tube (CRT) display device.

21. A display data format conversion method to facilitate display on at least a first display device based on display data for a second display device comprising:

producing a first display timing signal associated with the first display device; and resynchronizing display frames for the at least first and second display devices based on both the first display timing signal and a second display timing signal associated with the second display device, by dynamically evaluating frame synchronization to, if necessary, continuously vary a frame rate of the first display device to be consistent with a frame rate of the second display device by varying a blanking interval and allocating detected frame delay error among a plurality of regions of a display frame on the first display device.

22. The method of claim 21 including:

generating second display source frame end data based on the display resolution data corresponding to at least the second display device and the second display timing signal;

generating first display end frame data based on the display resolution data corresponding to at least the first display device and the first display timing signal; and generating the frame timing correction data based on the second display source frame end data and the first display end frame data.

23. A display data format conversion circuit to facilitate display on at least a first display device based on display data for a second display device comprising:

a first display timing generator circuit associated with the first display device that produces a first display timing signal; and a resynchronization circuit, responsive to both the first display timing signal and a second display timing signal associated with the second display device, that dynamically evaluates frame synchronization to, if necessary, continuously vary a frame rate of the first display device to be consistent with a frame rate of the second display device by varying a blanking interval wherein the resynchronization circuit includes a frame error determinator, responsive to display resolution data corresponding to at least each of the first and second display devices, the first display timing signal and the second display timing signal, that generates frame timing correction data at the end of a frame based on expected end of frame data and actual end of frame data.

24. The circuit of claim 23 wherein the first display timing generator is a variable timing generator and the resynchronization circuit includes a variable timing control signal generator circuit that generates a variable first display timing signal to vary the frame rate of the first display device.

25. The circuit of claim 24 wherein the resynchronization circuit continuously and adaptively varies a horizontal blanking interval to vary the frame rate of the first display device to be consistent with a frame rate of the second display device, to facilitate synchronized dual display of common display data on at least the first and second display devices.

26. A display data format conversion circuit to facilitate display on at least a first display device based on display data for a second display device comprising:

a first display timing generator circuit associated with the first display device that produces a first display timing signal; and a resynchronization circuit, responsive to both the first display timing signal and a second display timing signal associated with the second display device, that dynamically evaluates frame synchronization to, if necessary, continuously vary a frame rate of the first display device to be consistent with a frame rate of the second display device by varying a blanking interval and wherein the resynchronization circuit includes a frame error distribution circuit that allocates detected frame delay error from each frame among a plurality of regions of a display frame on the first display device.

27. The circuit of claim 26 wherein the first display timing generator is a variable timing generator and the resynchronization circuit includes a variable timing control signal generator circuit that generates a variable first display timing signal to vary the frame rate of the first display device.

28. The circuit of claim 26 wherein the resynchronization circuit includes a frame error determinator, responsive to display resolution data corresponding to at least each of the first and second display devices, the first display timing signal and the second display timing signal, that generates frame timing correction data at the end of a frame based on expected end of frame data and actual end of frame data.

* * * * *